United States Patent [19]

Schmidt

[11] Patent Number: 4,813,572

[45] Date of Patent: Mar. 21, 1989

[54] APPARATUS FOR SUCCESSIVE PREPARATION OF FAST FOOD ARTICLES

[76] Inventor: Jan Schmidt, Nordborggade 28, DK-8000 Aarhus C., Denmark

[21] Appl. No.: 91,394

[22] Filed: Aug. 31, 1987

[30] Foreign Application Priority Data

Aug. 29, 1986 [DK] Denmark ..... 4115/86

[51] Int. Cl.[4] ..... G07F 11/00

[52] U.S. Cl. ..... 221/150 HC; 99/357

[58] Field of Search ..... 221/150 HC, 150 A; 99/357

[56] References Cited

U.S. PATENT DOCUMENTS

| | | | |
|---|---|---|---|
| 2,790,379 | 4/1957 | Rothstein et al. | 99/357 |
| 3,653,541 | 4/1972 | Crum | 221/150 HC |
| 3,866,795 | 2/1975 | Urano | 221/150 HC |

FOREIGN PATENT DOCUMENTS

| | | | |
|---|---|---|---|
| 58791 | 6/1941 | Denmark | 99/357 |

*Primary Examiner*—F. J. Bartuska

*Attorney, Agent, or Firm*—Sixbey, Friedman, Leedom & Ferguson

[57] ABSTRACT

A vending machine for fast food articles such as warm burgers comprises a freezing store, a microwave oven and handling and control device for successively transferring a paper wrapped article from the store to the oven and, thereafter, from the oven to a delivery position. The oven has a bottom hinged door, the rear side of which is provided with an article carrier plate having a shape suitable for receiving the articles when the lid is partly open and for bringing the articles into the oven in response to the door being closed. Moreover, the carrier plate serves to guide the heated articles out of the oven into a dispensing receptacle in response to the door being opened to a fully open, downwardly inclined position.

2 Claims, 1 Drawing Sheet

APPARATUS FOR SUCCESSIVE PREPARATION OF FAST FOOD ARTICLES

Figure 1:
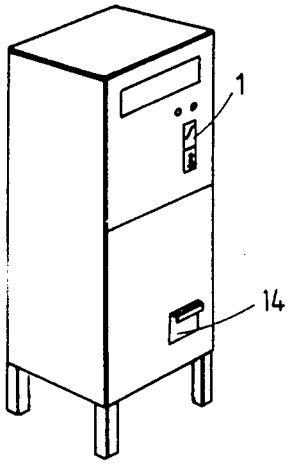

The present invention relates to an apparatus for successive preparation of fast food articles, comprising a store for such articles and means for releasing articles therefrom, an oven for receiving and heating the articles, and means for conveying the heated articles to a dispensing position spaced from the oven, the oven having a bottom hinged front door provided with an article carrier plate projecting into the oven when the door is closed and operable to receive the articles from the store when the door assumes a partly open, outwardly and upwardly inclined position, the door being further openable to an article delivery position, in which it is outwardly and downwardly inclined so as to enable an article leaving the carryer plate to slide down to said dispensing position, e.g. down into a delivery box.

An apparatus of this type is disclosed in the U.S. Pat. No. 3,653,541, which relates to a coin actuated vending machine for heated food items such as burgers. The apparatus comprises a freezing store compartment for frozen food units and means for releasing the units singularly from the store to a fall down position, from which the unit is dropped so as to be received on the underlying, partly open door of the oven, the door being connected with suitable moving control means operable to both close the door and open it still further. When the unit falls down on the rear side of the partly open door it will slide down along this rear side until it is stopped by the said carrier plate, whereafter the carrier plate is swung rearwardly and downwardly to a carrier position inside the closed oven. Thereafter, the unit is heated as required, and then the door is caused to be opened widely into a forwardly and downwardly inclined position, whereby the carrier plate is swung correspondingly upwardly and outwardly. Hereby the heated unit will slide down along the inner or rear side of the door, down to a suitable dispensing position for reaching the customer. Thereafter the door is returned to its partly open position so as to be ready for a new operation cycle.

In the said earlier disclosed apparatus the carrier plate projects from the closed oven door horizontally into the oven just above the bottom thereof, i.e. the carrier plate projects perpendicularly from the lower area of the door. It has been found that this introduction arrangement has a considerable drawback, viz. in that a burger unit, which in vending machines will consist of two flat buns with an intermediate layer of meat and various stuffing so as to constitute a relatively flat unit, will slide along the door in a lying position and thus be stopped by the carrier plate in a position edgewise standing thereon; when the door is closed the paper or sheet wrapped unit will often keep standing on the carrier plate without tilting to a lying position, and when the unit is heated in an upright position the partly liquid stuffing will collect adjacent the lower end of the unit, whereby the finished product may be very inhomogeneous with respect to the distribution of the stuffing. Moreover, the unit as standing immediately along the rear side of the door will not be heated optimally, and there may even occur some adherence to the door, whereby the food unit will not always slide down along the door when the latter is opened to its downwardly inclined delivery position.

Ideally, of course, the food unit should be safely introduceable into a substantially horizontal heating position somewhat inside the oven, spaced from the door thereof, and the unit should be equally safely deliverable from the oven after the heating treatment; obviously these requirements may be readily fulfilled with the use of specialized handling means and even a specially designed oven, but it is equally obvious that it desirable to make use of simple positioning means in connection with a standard oven.

It is the purpose of the invention to solve this problem in a simple manner. Based on a comprehensive development work it has been found that the above ideal solution can be worked out in a manner, which is constructively as simple as the said known arrangement, only with another shaping and mounting of the carrier plate.

According to the invention the carrier plate is secured to the oven door in such a manner that in the closed position of the door it projects downwardly and inwardly into the oven from an upper area of the rear side of the door along an arched path of the magnitude of 90°. Thus, instead of projecting orthogonally rearwardly from a lower area of the door, the carrier plate will extend as a quarter of a circular cylindrical member, which leaves the upper rear side area of the door in a tangential manner, and by a 45° opening of the door the carrier plate will be swung into a position, in which it extends downwardly and inwardly to a lowermost middle area and therefrom further inwardly and upwardly. Thus, a downwardly sliding food unit will not proceed further than to the middle portion of the carrier plate, but when the door is closed the carrier plate will be pivoted into the oven chamber such that the unit will thereby slide further inwardly along the carrier plate into an at least substantially horizontal position inside this chamber. It is ensured hereby that the food unit has no possibility of arranging itself so as to stand edgewise, and it is also ensured that the unit will be moved a certain distance into the oven chamber.

When the food unit is to be delivered from the oven by the wide opening of the door thereof the unit will start sliding outwardly along the arched carrier plate as soon as the latter is swung out or rather as soon as the inclination of the unit supporting area of the carrier plate is sufficient for conditioning such a sliding, and during the pivoting the unit will slide further along the arched plate member until it can leave the plate member over the outer end thereof as extending tangentially to the upper or outer end portion of the door. Normally the arched configuration of the carrier plate will mean that the flat food units cannot adhere very strongly to the carrier plate, but even in case of a certain adherence, which in the said earlier apparatus would mean a stop of delivery, there will occur an extra liberation effect in connection with the invention, insofar as by the stopping of the opening movement of the door the unit will be subjected to an off-throwing impact as a consequence of the unit being located relatively far from the pivot axis of the door, while in the known apparatus the unit is located quite close to that axis. For the same reason the invention provides for an increased safety of delivery, which is obviously an important advantage.

Figure 2:
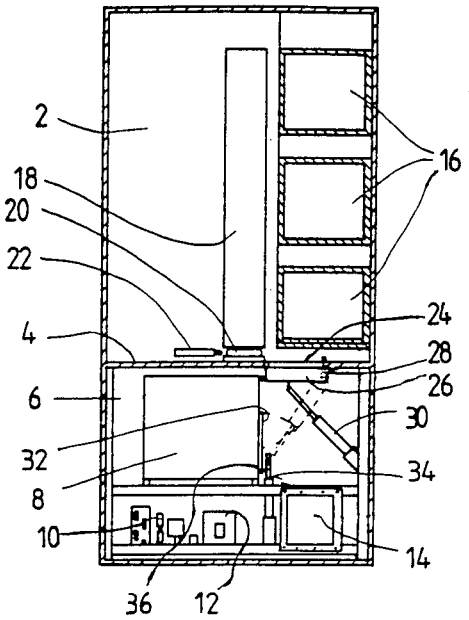
Figure 3:
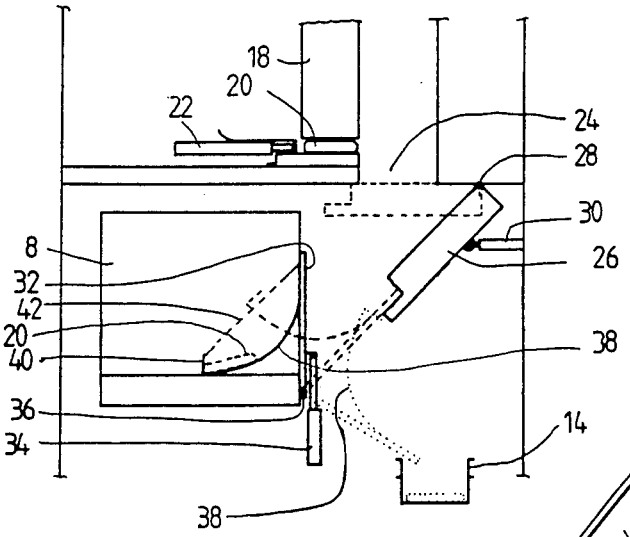
Figure 4:
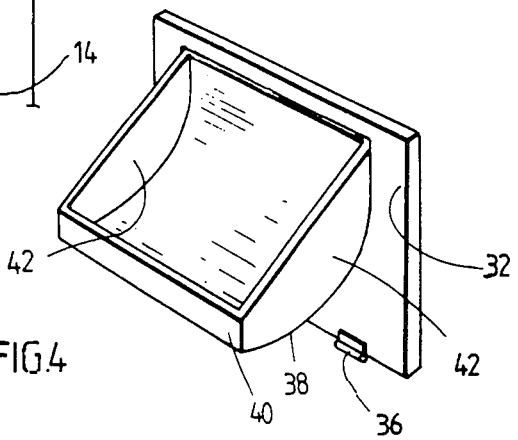

In the following the invention is described in more detail with reference to the drawing, in which:

FIG. 1 is a perspective general view of an apparatus according to the invention, FIG. 2 is a front view of the interior thereof, FIG. 3 is a corresponding view of a sub portion thereof, and FIG. 4 is a perspective view of the door of an even in the apparatus.

The apparatus as shown in FIGS. 1 and 2 is a vending machine having an upper freezing store 2, a heat insulated intermediate bottom 4 and an underlying chamber 6 housing a microwave oven 8, a control equipment 10, a freezing compressor 12 and a dispenser drawer 14. The freezing store houses some supply boxes 16 for frozen burger members and one or more magazine tubes 18 for such members, of which one is shown underneath the lower end of the tube 18. A pushing cylinder 22 is provided adjacent the lower tube end such that this cylinder is operable to push the member 20 laterally into a position above a hole 24 in the intermediate bottom 4. Underneath the bottom 4 this hole is covered by a heat insulating flap 26, which is downwardly pivotable about a hinge 28 and controlled by a cylinder 30.

The oven 8 is a standard type microwave oven having a front door 32, which, by means of a control cylinder 34 is outwardly pivotable about a lower hinge 36, the door hereby being pivotal between a vertical, closed position and two different open and inclined positions, viz. an outwardly an upwardly inclined receiving position and an outwardly and downwardly inclined delivery position, the door in both cases forming an angle of some 45° with the horizontal. In the outwardly and upwardly inclined position the door is suited to receive a burger member 20 falling through the hole 24, the burger member being guided towards the rear side of the door by sliding down along the swung down cover flap 26 underneath the hole 24.

Thereafter the member 20 is introduced into the oven by the door 32 being closed, and when the oven has been activated for the required period of time the cylinder 34 is operated to pivot outwardly and downwardly to a downwardly inclined position, in which the burger member 20 slides down for delivery to the drawer 14.

As shown in more detail in FIGS. 3 and 4 the top end of the rear side of the door 32 is provided with a carrier plate 38, which extends as a quarter of a circular cylindric plate member, leaving the door tangentially downwardly and inwardly, whilst inside the oven it is terminated by an upstanding stop flange 40. Side plates 42 are provided at both sides of the carrier plate.

By actuation of the apparatus, preferably by coin insertion through a slot 1 as shown in FIG. 1, the control equipment actuates the cylinder 30 to pivot the flap 26 into a downwardly inclined position, and the door of the oven is opened to an upwardly inclined position, in which it can receive a burger member 20 pushed onto the hole 24 from the magazine 18 by means of the cylinder 22.

The upwardly inclined position of the door 32 is shown in dash lines in FIG. 3. It will be noted that the carrier plate 38 behind the oven door assumes a bowl-like position, whereby the burger member 20 sliding down along the carrier plate will stop near the middle area of this bowl surface, where the flat member 20 will be sure to be delivered in a lying position. Thereafter both the door 32 and the flap 26 are closed by means of their respective control cylinders, and the oven is switched on.

By the closing of the oven door 32 the carrier plate 38 is swung to the position shown in full lines inside the oven, and by the associated pivoting the member 20 will slide further rearwardly on the carrier plate 38 to the position shown in dotted lines, clearly spaced from the door 32 and just above the inner bottom of the oven.

The oven is switched off when the burger member has been duly heated, and the door 32 is opened into its downwardly inclined position, which is shown in dotted lines. During that pivoting the member 20 slides forwardly on the carrier plate 38 and finally slides over the outer edge of the door down into the delivery drager 14. Thereafter the door is closed again, and the apparatus is then ready for a renewed operation cycle.

Even if the door, by its swinging into the fully open position, is not stopped in a fully abrupt manner the stopping will nevertheless give rise to a certain throwing action on the burger member, should this exceptionally adhere to the carrier plate in the outermost position thereon, since the member 30 will then be located well spaced from the pivot axis of the door. By this throwing action the member 20 will fall almost direct down into the dispenser drawer.

The carrier plate 38 should not necessarily be shaped as a quarter of a circular cylindrical surface, but this shape has been found extra advantageous.

I claim:

1. An apparatus for successive preparation of fast food articles, comprising a store for such articles and means for releasing articles therefrom, an oven for receiving and heating the articles, and means for conveying the heated articles to a delivery position spaced from the oven, the oven having a bottom hinged front door provided with an article carrier plate projecting into the oven when the door is closed and operable to receive the articles from the store when the door assumes a partly open, outwardly and upwardly inclined position, the door being further openable to an article delivery position, in which it is outwardly and downwardly inclined so as to enable an article leaving the carrier plate to slide down to the delivery position, e.g. down into a delivery drawer, characterized in that the carrier plate has a first end that is substantially tangentially secured to the oven door and a second end that is oriented 90° relative to said first end via a quarter circular plate portion in such a manner that, in the closed position of the door, the carrier plate projects downwardly and inwardly into the oven from an upper area of the rear side of the door along an arched path of 90°.

2. An apparatus according to claim 1, in which the articles are released from a freezing store through a downlet opening located above the oven door in the said partly open position thereof, characterized in that the downlet opening is provided in a bottom area of the freezing store and is covered by a lower pivot flap operable to be pivoted downwardly to an inclined position, wherein a free end of the pivot flap is located in proximity to a free end of the partly opened oven door and in which it can receive an article released through the downlet opening and guide the article to slide down onto the upper rear area of the partly open oven door.

* * * * *